United States Patent [19]

Kern et al.

[11] Patent Number: 4,923,366

[45] Date of Patent: May 8, 1990

[54] REVERSIBLE TURBINE PUMP

[75] Inventors: Jeffrey A. Kern; Roger L. Hoffman, both of Louisville, Ky.

[73] Assignee: General Electric Company, Louisville, Ky.

[21] Appl. No.: 304,478

[22] Filed: Feb. 1, 1989

[51] Int. Cl.[5] ..... F01D 1/30

[52] U.S. Cl. ..... 415/152.1; 415/107; 415/911

[58] Field of Search ..... 415/146, 152.1, 911, 415/174.2, 174.3, 104, 107, 172.1; 277/DIG. 9; 68/208

[56] References Cited

U.S. PATENT DOCUMENTS

| | | | |
|---|---|---|---|
| 2,838,002 | 6/1958 | Cohen | 415/911 |
| 2,883,843 | 4/1959 | Bochan | 68/23.5 |
| 3,127,839 | 4/1964 | Pinder | 415/911 |
| 3,127,840 | 4/1964 | Bochan | 415/146 |
| 3,836,001 | 9/1974 | Heldreth | 415/121.2 |
| 4,080,112 | 3/1978 | Zimmermann | 415/104 |
| 4,091,664 | 5/1978 | Bochan | 68/18 E |
| 4,306,841 | 12/1981 | Morrison et al. | 417/360 |
| 4,331,295 | 5/1982 | Warihashi | 415/911 |
| 4,822,241 | 4/1989 | Jarvis et al. | 415/104 |

FOREIGN PATENT DOCUMENTS 138666 10/1901 Fed. Rep. of Germany ..... 415/911

*Primary Examiner*—Robert E. Garrett
*Assistant Examiner*—John T. Kwon
*Attorney, Agent, or Firm*—Radford M. Reams; H. Neil Houser

[57] ABSTRACT

A reversible turbine pump includes a pair of end walls and a side wall defining an annular pumping chamber. A turbine impeller mounted for reversible rotation in the chamber includes a rigid input shaft. One end of the shaft extends through one end wall and is sealed from the chamber. A spring biases the other end of the shaft toward the other end wall. Cooperating thrust bearing members, mounted to the other end of the shaft and the other end wall, provide a large planar area of low friction engagement therebetween. The pumping chamber has a pair of inlets, a pair of outlets and a dam. The first inlet and second outlet are on one side of the dam while the second inlet and first outlet are on the other side of the dam so that reverse rotation of the impeller pumps fluid in opposite directions through a different set of inlet and outlet. Valves associated with the inlets and outlets permit fluid flow in the desired direction and prevent fluid flow in the opposite direction.

8 Claims, 4 Drawing Sheets

FIG.2
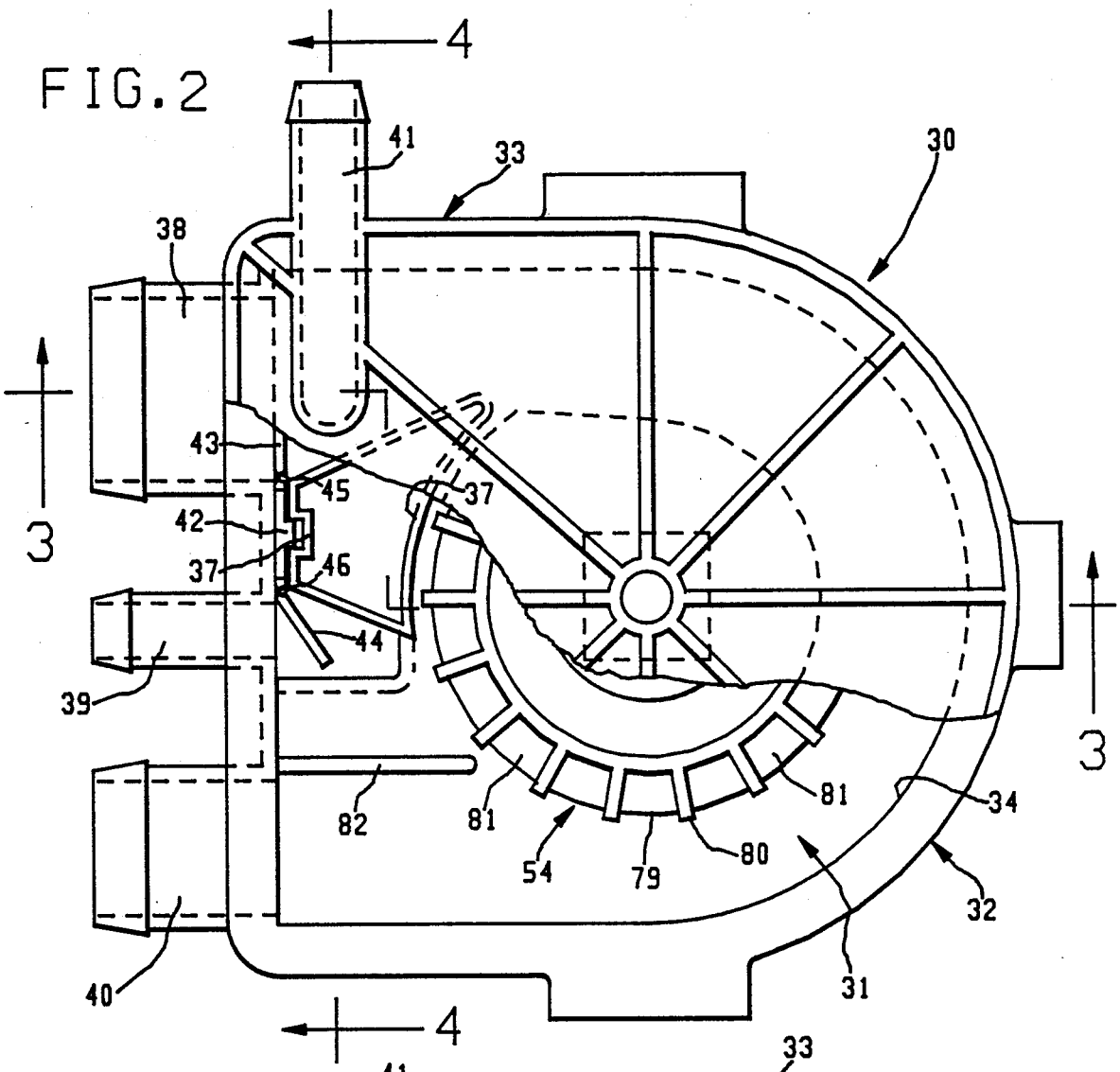
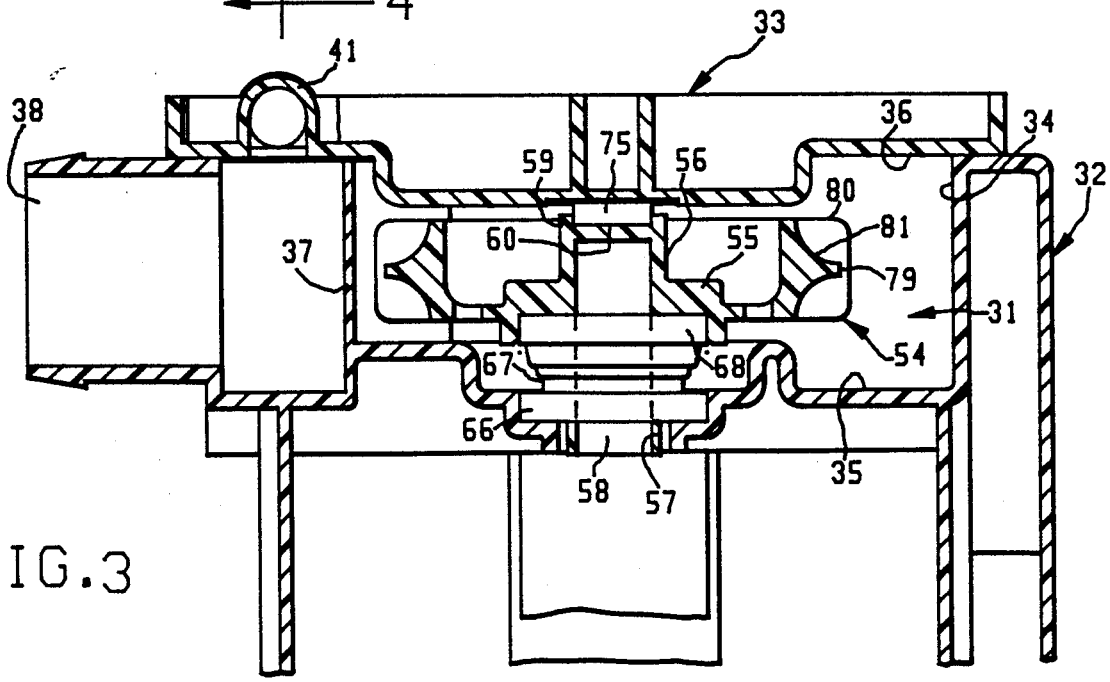
FIG.3

REVERSIBLE TURBINE PUMP

BACKGROUND OF THE INVENTION

This invention relates to turbine pumps. A turbine pump is a type of rotary pump having blades at the outer periphery of the impeller to move fluid through an annular pumping chamber within a casing from an inlet to an outlet as the impeller rotates. A dam is provided in the casing to direct pumped fluid to the outlet.

Turbine pumps have a number of uses, including fabric washing machines for example. In such machines the pump acts to remove water from the tub and discharge it to a drain. Often the pump also acts to recirculate water from the tub through a filter and back to the tub. Turbine pumps are particularly adapted for use in fabric washing machines because the impeller may be spaced relatively far from the peripheral wall of the pump chamber. This enables the pump to pass lint and small objects, such as buttons for example, which become entrained in the water.

Typically in clothes washers, it is desired to provide a higher rate of fluid flow during drain than during recirculation. One approach to obtain such an operation is illustrated in U.S. Pat. Nos. 3,127,839 and 3,127,840, both of which are assigned to General Electric Company. Those pumps have reversible impellers and use separate halves of the pumping chamber to pump fluid, depending on the direction of impeller rotation. While effective, this approach does not make most efficient use of the pump in either direction.

Some such pumps are "double decked;" that is, they effectively have two impellers in separate chambers. A different impeller is utilized for each direction of impeller rotation. Such constructions are rather complicated, which adds to the cost of manufacture.

It is an object of the present invention to provide a reversible turbine pump.

It is another object of this invention to provide such a reversible turbine pump which makes optimum use of the pumping cavity.

It is a further object of this invention to provide such a pump which can be accurately assembled in a low cost manner in an automated assembly operation.

SUMMARY OF THE INVENTION

One embodiment of the invention provides a reversible turbine pump comprising a casing having a pair of end walls and an annular pumping chamber. A turbine impeller is mounted for reversible rotation within the chamber and includes a rigid input shaft having a first end extending through a first casing end wall and a second end positioned adjacent a second casing end wall. A seal mechanism provides a fluid seal between the first shaft end and the annular pumping chamber. The seal mechanism includes a spring biasing the second shaft end toward the second casing end wall. Thrust bearing members mounted on the second shaft end and the second casing end wall provide a large, generally planar area of low friction engagement therebetween.

A dam positioned within the pumping chamber substantially interrupts the path around the chamber. The casing includes first and second inlets and outlets through which fluid enters and exits the chamber. The first inlet and second outlet are on one side of the dam while the second inlet and first outlet are on the other side of the dam so that impeller rotation in one direction pumps fluid through the first inlet and first outlet while impeller rotation in the other direction pumps fluid through the second inlet and second outlet. Valves associated with the inlets and outlets permit fluid flow in the desired direction and prevent fluid flow in the opposite direction.

BRIEF DESCRIPTION OF THE DRAWINGS

FIG. 2 is a plan view, partly broken away, a turbine pump incorporating an embodiment of the present invention.

FIG. 3 is a sectional elevation view taken along line 3—3 of FIG. 2.

DESCRIPTION OF THE PREFERRED EMBODIMENTS

Figure 1:
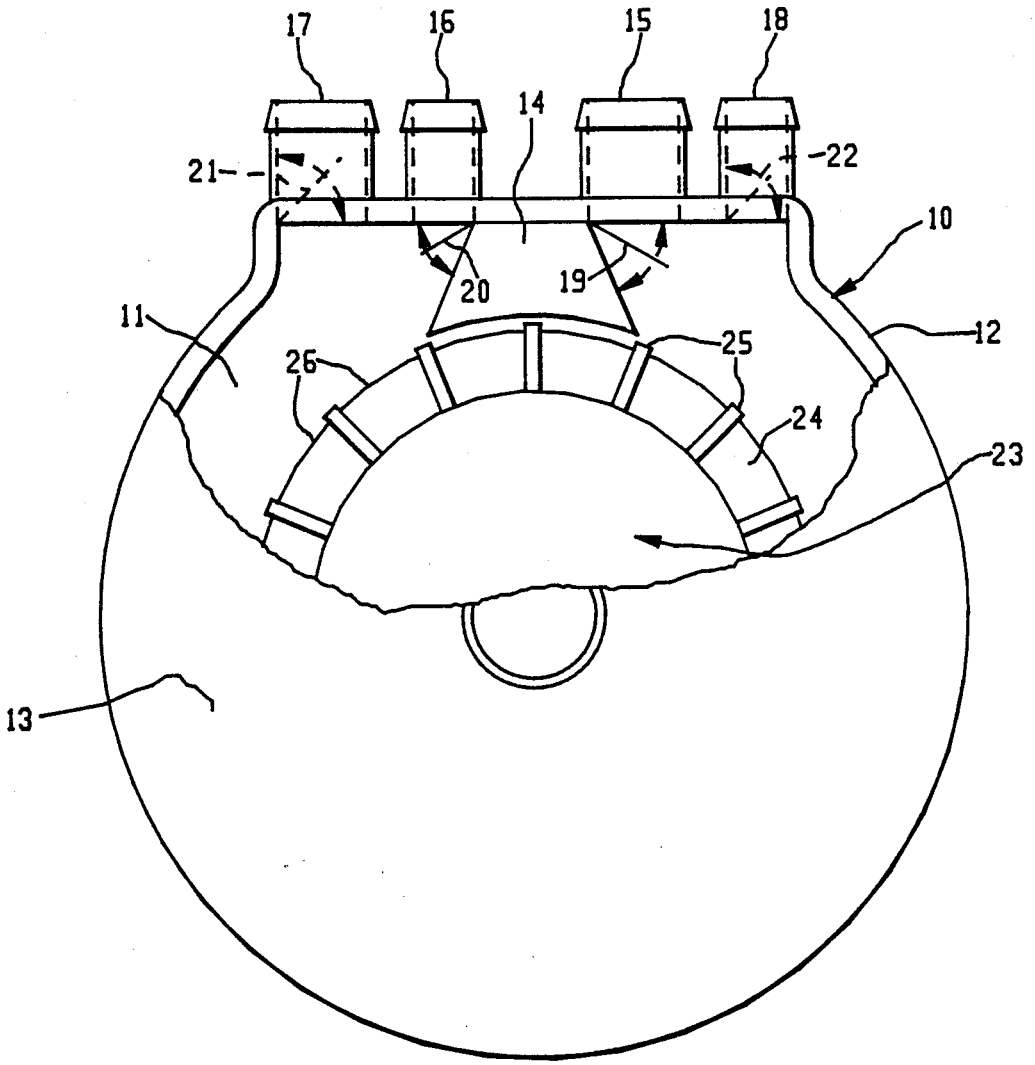
FIG. 1 is a schematic plan view, partly broken away, of a turbine pump illustrating certain aspects of the present invention.

FIG. 1 of the drawings is a schematic illustration of a reversible turbine pump illustrating certain aspects of the present invention according to one embodiment thereof. The pump has a casing 10 which defines an annular pumping chamber 11, the casing being formed from a body 12 and coverplate 13. These two elements are held in an assembled relation by any suitable means. For example, if made from metal they may be held together by welding or by bolts with a suitable gasket sandwiched between them to prevent fluid leakage. On the other hand if made from some suitable plastic material they conveniently may be joined by other means such as a plastic welding process or a suitable adhesive to provide a fluid tight joint without the need of a gasket.

A dam 14 interrupts the annular path around the pumping chamber 11. First and second fluid inlets 15 and 16 respectively are provided on opposite sides of and adjacent to the dam 14 for admitting fluid from any desired source into the pumping chamber 11. First and second outlets 17 and 18 respectively are also provided on opposite sides of dam 14 for discharge of fluid from the pumping chamber 11. First inlet 15 and first outlet 17 are also on opposite sides of the dam 14 from each other as are second inlet 16 and second outlet 18. Valve means are associated with each of the inlets and outlets, such as the simple flap valves 19, 20, 21 and 22 shown adjacent the inlets and outlets 15, 16, 17 and 18 respectively. The flap valves are constructed and mounted to allow fluid flow in one direction through the associated inlet or outlet and to block fluid flow in the other direction. More specifically valve 19 allows fluid to flow through inlet 15 into the annular chamber 11 but prevents fluid flowing out of the chamber through inlet 15; valve 21 permits fluid to be discharged from the chamber through outlet 17 while preventing entry of fluid through outlet 17 into the chamber 11; valve 20 permits entry of fluid through inlet 16 while preventing discharge of fluid through that inlet; and valve 22 permits discharge of fluid through outlet 18 while preventing the entry of fluid through that outlet. The positioning of the inlets and outlets relative to the dam, in conjunction with the operation of the flap valves, permits fluid to enter the pumping chamber 11 through inlet 15 and to discharge through outlet 17, with inlet 16 and outlet 18 being blocked, and permits fluid to enter through inlet 16 and to discharge through outlet 18, with inlet 15 and outlet 17 then being blocked.

An impeller 23 is reversibly rotatably mounted within the casing 10 centrally of the annular pumping chamber 11. Impeller 23 selectively may be driven in either the clockwise or counter clockwise direction, as seen in FIG. 1, by any suitable power source such as an electric motor (not shown). The impeller 23 has a generally disk-like shape, with a circumferential web 24 extending into the annular pumping chamber 11. On both the upper and lower sides of the web 24, spaced apart peripheral radial vanes 25 are formed. The radially directed vanes 25 and circumferential web 24 define fluid entraining pockets 26 spaced about the periphery of the impeller. These pockets 26 entrain the pumped fluid and move it as the impeller rotates within the annular pumping chamber 11. When the impeller 23 rotates in a clockwise, as seen in FIG. 1, direction it draws fluid in through inlet 15 and discharges it through outlet 17. When the impeller rotates in the counterclockwise direction, as seen in FIG. 1, fluid is drawn in through inlet 16 and discharged through outlet 18. In each direction the pump is operating efficiently as it utilizes substantially all the available annular pumping chamber. In the illustrative embodiment of FIG. 1 inlet 15 and outlet 17 are larger than inlet 16 and outlet 18. Thus the pump will pump more fluid when the impeller rotates in the clockwise direction than when the impeller rotates in the counterclockwise direction as the inlet 16 and outlet 18 restrict the flow of fluid more than the inlet 15 and outlet 17.

FIGS. 2–6 illustrate various details of a reversible turbine pump in accordance with another embodiment of the present invention. The pump includes a casing 30 which defines a generally annular pumping chamber 31, the casing being formed by a body element 32 and a cover 33. The body element 32 provides a generally annular side wall 34 and bottom or end wall 35 while the cover 33 provides a top or end wall 36. The walls 34, 35 and 36 define the substantially annular pumping chamber 31. In this illustrative embodiment the cover 33 and body 32 have been joined to provide a substantially fluid tight pumping chamber. A dam 37 is formed integrally with the body element 32 and extends substantially completely between the bottom wall 35 and top wall 36 so as to interrupt the fluid path around the annular chamber 31. First and second inlets 38 and 39 respectively and first and second outlets 40 and 41 respectively are provided with the same relationship to the dam 37 as the inlets and outlets relate to the dam in the embodiment illustrated in FIG. 1. Structurally inlets 38 and 39 and outlet 40 are provided in the annular wall 34 while outlet 41 is provided in the cover 33.

Figure 4:
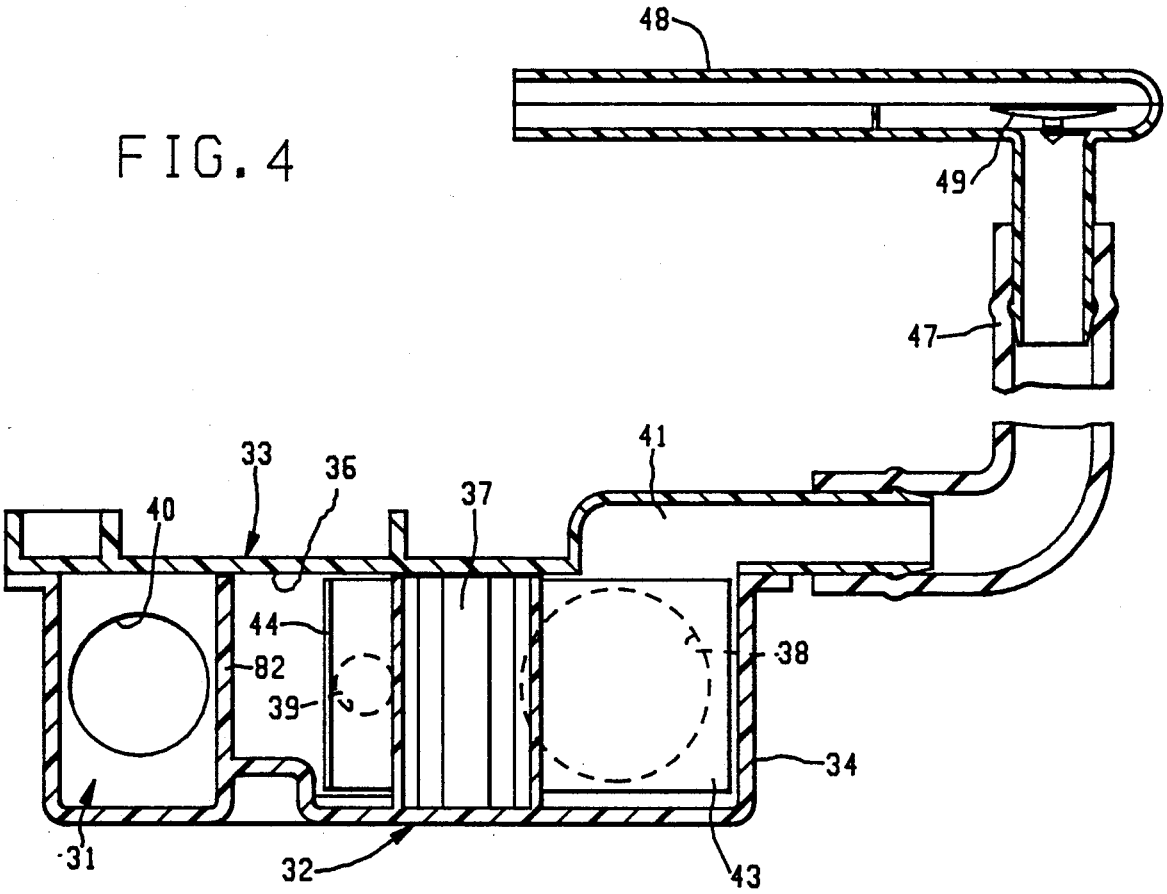
FIG. 4 is a sectional elevation view taken along line 4—4 of FIG. 2 and illustrating one outlet connected to an associated conduit mechanism.
Figure 5:
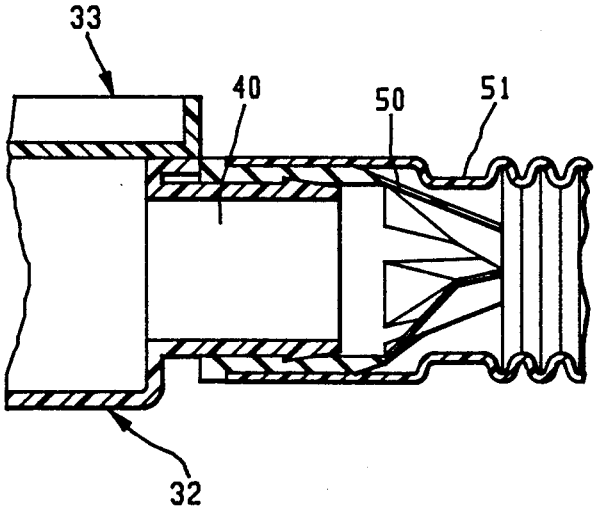
FIG. 5 is a fragmentary, sectional elevation view illustrating the connection of another outlet to an associated conduit.

Check valves for the inlets 38 and 39 are provided by a unitary sheet of material having a stiff central base section 42 and a pair of stiff distal valve sections 43 and 44 joined to the base section by reduced thickness hinge sections 45 and 46. The base section is held between the dam 37 and annular wall 44 so that the valve section 43 is positioned adjacent inlet 38 and the valve section 44 is positioned adjacent inlet 39. Thus the valve sections 43 and 44 provide flap type check valves for the inlets 38 and 39 respectively. Opening movement of the valve sections 43 and 44 is limited by engagement with the dam 37 while, in their closed position, the valve sections 43 and 44 engage the annular wall surrounding the inlets 38 and 39. While it is necessary that a check valve be associated with each of the inlets and outlets it is not necessary that the valves be a physical part of the pump housing or casing. To this end, as best seen in FIG. 4, the outlet 41 is connected by a length of flexible hose 47 to a flow control housing 48. A diaphragm or butterfly valve 49 is mounted in the housing 48 and, in a well known fashion, is effective to permit fluid to flow outwardly through the outlet 41 while preventing fluid from flowing inwardly through the outlet 41. In a similar manner, viewing FIG. 5, a fluted valve 50 is captured between the outlet 40 and a conduit or hose 51. As is well known, the fluted valve 50 will allow fluid to flow outwardly through outlet 40 while preventing the flow of fluid inwardly through outlet 40. It will be recognized that the inlet and outlet arrangement and valves illustrated in FIGS. 2–5 function operationally in the same manner as the structure of the embodiment illustrated in FIG. 1. That is, fluid may be drawn into the pump through inlet 38 and discharged through outlet 40, with inlet 39 and outlet 41 being blocked from unwanted flow, and fluid may be drawn in through inlet 39 and discharged through outlet 41, with inlet 38 and outlet 40 then being blocked from unwanted flow.

An impeller 54 is mounted within the casing 30 and centrally of the annular pumping chamber 31. Preferably the impeller is of a rigid construction and, for example, may be molded from a suitable plastic material such as, for example, glass filled polypropylene. The impeller 54 includes a generally cylindrical body section 55 formed integrally with a central input or drive shaft 56. The drive shaft 56 has a first hollow end section 57 which extends through the end wall 35 of casing 32 and includes a central recess 58. The shaft 56 includes a second end section 59 having a distal recess 60 facing the end wall 36.

Figure 6:
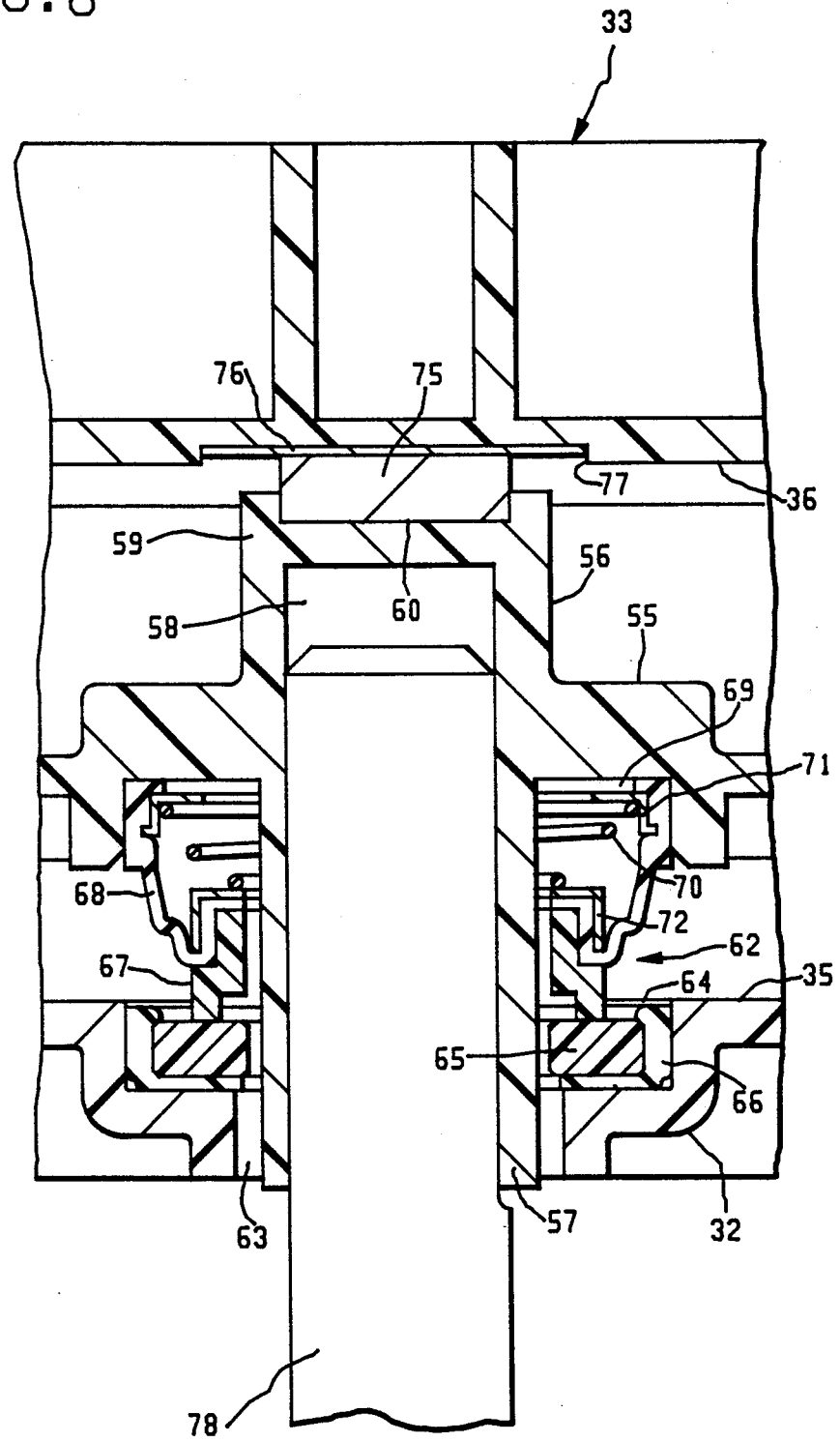
FIG. 6 is a fragmentary sectional elevation view of the hub portion of the impeller of the pump of FIG. 2.

Referring now more particularly to FIG. 6, it will be seen that a seal mechanism, generally indicated at 62, seals the impeller shaft portion 57 from the annular pumping chamber 31 to prevent fluid leaking out of the chamber around the shaft end. More particularly the end wall 35 of body element 32 is formed with an opening 63 through which the shaft end 57 extends. A recess 64 is formed in the end wall 35 around the opening 63 and a ceramic face seal member 65 is mounted within the recess 64 by means of a flexible gasket 66 which conveniently may be made of vinyl or a rubber compound. A ceramic nose seal 67 is carried by a flexible boot 68. One end of the boot fits around the outside of the nose seal while the other end of the boot fits within a recess 69 formed in the impeller body 55. A spring 70 is mounted within the boot 68 between metal retaining members 71 and 72 respectively. The spring tends to expand longitudinally of the impeller shaft end 57. One result is that it biases the nose seal 67 into firm contact with the face seal 65. This prevents leakage of fluid past the junction of these two members. The ceramic material of the seals 65 and 67 is chosen to provide a low coefficient of friction engagement.

A first thrust bearing member 75 is mounted in the recess 60 for rotation with the shaft in 59. Conveniently the thrust member 75 may be formed from a suitable low friction impregnated self lubricating plastic material such as that sold by Dixon Industries under the tradename Rulon-123. The thrust member 75 has a generally planar outer surface. A second thrust bearing member 76 is mounted in a recess 77 in end wall 36 in register with the end of thrust bearing member 75. Conveniently the thrust bearing member 76 may be formed from stainless steel or other rigid material and is stationarily mounted in the recess 77 by conventional means such as the use of an adhesive or by providing the thrust member with a non circular circumferential configuration and a tight fit in the recess 77. The thrust bearing members 75 and 76 are configured to provide a large, generally planar area of low friction engagement therebetween.

The spring 70 also biases the impeller upwardly, as seen in FIG. 6, so that the shaft end 59 is biased toward the end wall 36 and engagement between thrust bearing member 75 and 76 is assured. This construction assures that the impeller is properly seated in the casing 30 without the necessity of relying on the input means to position the impeller. For example, in FIG. 6, an input means such as a motor shaft 78 is drivingly received in the impeller shaft portion 57 to rotate the impeller without the necessity of there being any particular axial positioning between the shaft 78 and impeller 54 to properly position the impeller. This enhances the pump assembly process and helps enable the pump to be quickly and permanently assembled.

As best seen in FIG. 3, the impeller body section 55 includes a generally circumferentially extending web 79 extending into the annular pumping chamber 31. Spaced apart peripheral radial vanes 80 are formed at the outer edge of the impeller 54 and extend both above and below the web 79. The radially directed vanes 80 and circumferential web 79 define fluid entraining pockets 81 spaced about the periphery of the impeller. These pockets entrain the fluid and move it through substantially the entire periphery of the annular pumping chamber as the impeller rotates.

It will be noted that the turbine configuration of the impeller enables it to be spaced a substantial distance from the annular peripheral wall 34 of the pumping chamber. This enables the pump to pass foreign objects which may be entrained in the fluid such as lint and buttons, for example, in the case of a laundry pump. Since the second inlet 39 is relatively small it may be desirable to prevent such foreign objects from coming into the vicinity of the valve section 44 when the pump is transferring liquid from inlet 38 to outlet 40 as such foreign objects could disrupt proper operation of the valve section 44. To this end, a wall 82 is provided within the annular chamber 31 between the outlet 40 and the inlet 39. This wall serves to block such foreign objects from the area around the valve section 44. The wall 82 extends between the end walls 35 and 36 and is spaced sufficiently away from the edge of the impeller 54 that the open area between them is substantially larger in cross-section than the cross-sectional area of inlet 39. As a result of the relative sizes of these cross-sectional areas, the presence of the wall 82 will not detract from the pumping action as the impeller draws liquid in through inlet 39 and discharges it through outlet 41.

While this invention has been described by reference to particular embodiments, it will be understood that numerous modifications may be made by those skilled in the art without departing from the spirit of our invention. It is therefore, the purpose of the appending claims to cover all such variations as come within the true spirit and scope of the invention.

What we claim as new and desired to secure by Letters Patent of the United States is:

1. A reversible turbine pump comprising:

a casing defining an annular pumping chamber;

a turbine impeller mounted for reversible rotation within said chamber;

a dam positioned within said chamber for substantially interrupting the path around said chamber;

first and second inlets and first and second outlets through which fluid enters and exits said chamber;

said first inlet and second outlet being positioned on one side of said dam and said second inlet and first outlet being positioned on the other side of said dam so that rotation of said impeller in one direction pumps fluid through substantially all said chamber from said first inlet to said first outlet and rotation of said impeller in the other direction pumps fluid through substantially all said chamber from said second inlet to said second outlet;

said first inlet and outlet being sized to limit flow through said pump to a greater extent than said second inlet and outlet; and valve means associated with each of said inlets and outlets for permitting fluid flow therethrough in the desired direction and preventing fluid flow therethrough in the undesired direction.

2. A reversible turbine pump as set forth in claim 1 wherein said inlets are positioned adjacent opposite sides of said dam; said valve means associated with each inlet is a flap valve and said dam limits opening movement of each flap valve.

3. A reversible turbine pump as set forth in claim 2 wherein each of said flap valve is formed from an unitary sheet of material having a base section and a stiff valve section connected by a reduced thickness hinge section; said base section is mounted between said dam and said casing and said dam limits opening movement of said valve section.

4. A reversible turbine pump as set forth in claim 1 wherein: said valve means associated with said inlets is formed from an unitary sheet of material having a central base section and a pair of stiff distal valve sections, each of said valve sections being joined to said base section by a reduced thickness hinge section; said base section is mounted between said dam and said casing; and said dam limits opening movement of each of said valve sections.

5. A reversible turbine pump comprising:

a casing having a pair of end walls and an annular side wall defining an annular pumping chamber;

a turbine impeller mounted for reversible rotation within said chamber, said impeller including a rigid input shaft having a first end extending through a first of said casing end walls for driven connection to a reversible input means and having a second end positioned adjacent a second of said casing end wall;

seal mechanism providing a fluid seal between said first shaft end and said pumping chamber, said seal mechanism including a nose seal mounted on and rotating with said impeller and a stationary face seal mounted on said first casing end wall, said nose seal including spring means biasing said second impeller shaft end toward said second casing end wall;

a first thrust bearing member mounted for rotation with said second shaft end and a second thrust bearing member stationarily mounted to said second end wall to engage said first thrust bearing member, said thrust bearing members being configured to provide a large generally planar area of low friction engagement therebetween;

a dam positioned within said chamber for substantially interrupting the path around said chamber;

first and second inlets and first and second outlets through which fluid enters and exits said chamber;

said first inlet and second outlet being positioned on one side of said dam and said second inlet and first outlet being positioned on the other side of said dam so that rotation of said impeller in one direction pumps fluid through substantially all said chamber from said first inlet to said first outlet and rotation of said impeller in the other direction pumps fluid through substantially all said chamber from said second inlet to said second outlet;

said first inlet and outlet being sized to limit flow through said to greater extent than said second inlet and outlet; and valve means associated with each of said inlets and outlets for permitting fluid flow therethrough in the desired direction and preventing fluid flow therethrough in the undesired direction.

6. A reversible turbine pump as set forth in claim 5 wherein said inlets are positioned adjacent opposite sides of said dam; said valve means associated with each inlet is a flap valve and said dam limits opening movement of each flap valve.

7. A reversible turbine pump as set forth in claim 6 wherein each of said flap valves is formed from an unitary sheet of material having a base section and a stiff valve section connected by a reduced thickness hinge section; said base section is mounted between said dam and said casing side wall and said dam limits opening movement of said valve section.

8. A reversible turbine pump as set forth in claim 5 wherein: said valve means associated with said inlets is formed from an unitary sheet of material having a central base section and a pair of stiff distal valve sections, each of said valve sections is joined to said base section by a reduced thickness hinge section; said base section is mounted between said dam and said casing side wall; and said dam limits opening movement of each of said valve sections.

* * * * *